United States Patent [19]

Vossen

[11] 4,007,585

[45] Feb. 15, 1977

[54] TAPE TYPE YARN FEED SYSTEM FOR A KNITTING MACHINE

[76] Inventor: Robert Vossen, 35 E. Woods Drive, Huntington, N.Y. 11743

[22] Filed: Nov. 20, 1975

[21] Appl. No.: 633,711

[52] U.S. Cl. ..... 66/132 T; 226/172

[51] Int. Cl.[2] ..... D04B 15/48

[58] Field of Search ..... 66/132 T; 242/47.01; 226/172

[56] References Cited

UNITED STATES PATENTS

| | | | |
|---|---|---|---|
| 3,361,317 | 1/1968 | Levin | 66/132 T |
| 3,802,228 | 4/1974 | Deniega | 247/47.01 X |
| 3,855,821 | 12/1974 | Sterba | 66/132 T |
| 3,922,887 | 12/1975 | Mishcon | 66/132 T |

*Primary Examiner*—Mervin Stein
*Assistant Examiner*—A. M. Falik
*Attorney, Agent, or Firm*—Bauer, Amer & King

[57] ABSTRACT

A knitting machine of the type using positive contact of a moving tape to correspondingly urge the yarn in feed movement from its source to the machine knitting station, but wherein the movement of a first, comparatively large master tape is effectively transmitted to plural second smaller loops of tape associated with each yarn strand to provide said feed movement thereto. Thus, for example, any spinning oil in the yarn is deposited only on the smaller tape loop and, if it causes rupture thereof, correspondingly limits the loss thereto. This is in contrast to existing feed systems in which belt rupture from the foregoing occurs in the large master tape, and in which other shortcomings associated with using only a single, large master tape also occur.

1 Claim, 5 Drawing Figures

TAPE TYPE YARN FEED SYSTEM FOR A KNITTING MACHINE

The present invention relates to an improved technique of feeding yarn to a knitting machine.

It is already well known in the patent literature that it is advantageous in the operation of a knitting machine to cause feed movement of the yarn thereof using a master feed tape or belt. Exemplary of this patent literature is the Rosen U.S. Pat. No. 3,090,215. Characteristic of the patented arrangement referred to is a mode of operation in which the master feed belt contacts and thus causes positive feed of the yarn. Unfortunately, if there is excessive spinning oil on the yarn, the oil chemically attacks the material of construction of the belt. The aforesaid ultimately results in the rupture of the belt and thus the need for replacement. Since a single feed belt, of comparatively large length, is used in the patented systems, the replacement thereof represents a significant cost, to say nothing of the inconvenience and time lost in making the replacement.

Additionally, it is not uncommon in knitting operations to use different colors of yarns. Thus, it often happens in the known patented arrangements that the lint from one station is transmitted to another station by the single master feed belt or tape that is used. As a result, the lint in one color often attaches itself to yarn of another color, thereby producing a defect in the manufactured product.

Broadly, it is an object of the present invention to provide an improved feed system having the advantage of producing feed movement by direct contact of a tape with the yarn, but in which the aforesaid and other shortcomings of the prior art are obviated.

An improved yarn feed system for a knitting machine demonstrating objects and advantages of the present invention includes an arrangement, similar to the arrangement of existing patented feed systems, of rotatable tape-supporting wheels operatively arranged to support a closed loop of control tape and thus adapted to be powered in rotation in response to the longitudinal movement of said control tape throughout its looped path. Cooperating with the aforesaid is a first auxiliary wheel connected in depending relation to each of the tape-supporting wheels so as to rotate in unison therewith. A second auxiliary wheel rotatably mounted in an operative clearance position from each said first auxiliary wheel is provided, and a second closed loop of tape is entrained about each said cooperating pair of first and second auxiliary wheels. As a consequence, the rotation of the first auxiliary wheel urges the second closed loop of tape in movement and this movement, in turn, correspondingly occurs also at the partial wrap of the second closed loop of tape about the second auxiliary feed wheel. Thus, yarn fed in an interposed position between the second tape loop and the second auxiliary wheel at said partial wrap therebetween is urged by the second tape loop through feed movement at a speed related to the movement speed of the first or master control tape, but without actual contact with said master control tape.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein:

FIG. 1 is a front elevational view of a knitting machine embodying said prior art feed system.

FIG. 2 is an isolated perspective view illustrating further structural details of said prior art feed system.

Figure 1:
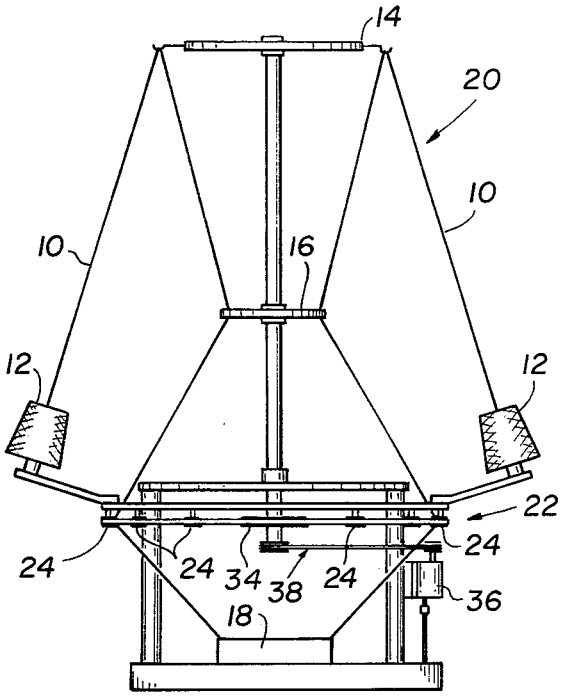
FIG.1 PRIOR ART
FIGS. 1 and 2 illustrate a prior art knitting machine feed system. Specifically.
Figure 2:
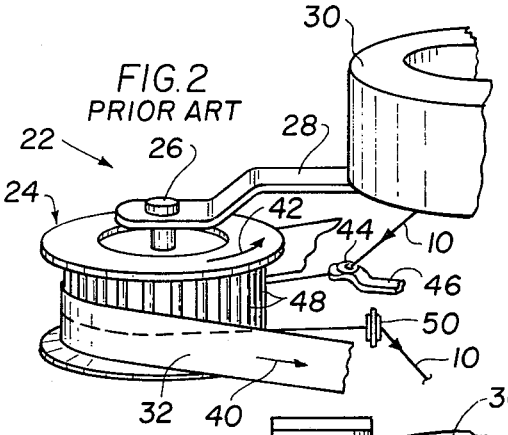
FIG.2 PRIOR ART

Reference is now made to the prior art feed system for a knittng machine of FIGS. 1 and 2. Since the construction and operation thereof are well understood, a detailed description is omitted as being unnecessary. It suffices to note that the operation of a knitting machine contemplates the feeding of plural lengths of yarn, individually and collectively designated 10, which may be of the same or different colors, from supply spools 12 in a looped path over an upper ring 14 and then in a descending orientation through an intermediate guide ring 16 and eventually terminating at what will be understood to be the knitting station 18 of the circular knitting machine 20.

As is perhaps best illustrated in FIG. 2, in the feed movement of the yarn 10 from its source 12 to the knitting station 18, a feed system, generally designated 22, is utilized to provide, in a positive fashion, feed movement to the yarn 10 at a selected speed. In this regard, a typical prior art feed system 22 includes a circumferential arrangement of feed wheels appropriately supported on the support frame of the knitting machine 20, one such feed wheel, designated 24, being specifically illustrated in FIG. 2. Each feed wheel 24 is appropriately journalled for rotation, as at 26, in depending relation from support bracket 28, which, in turn, is affixed to a mounting ring 30 or other frame or support structure of the knitting machine 20. As may be readily appreciated from FIGS. 1, 2, the circumferential arrangement of feed wheels 24 support a closed loop of master tape 32 which, in a well understood manner, is also entrained about a variable diameter pulley 34, as illustrated in FIG. 1. Also as illustrated in FIG. 1, the gear box 36, which is driven by and is synchronous to the knitting machine 20, drives a belt and pulley at a speed that, in turn, allows the variable diameter pulley 34 to urge the master tape 32 through longitudinal feed movement 40 at a predetermined rate. Naturally, movement 40 produces corresponding rotational movement 42 in each feed wheel 24. In accordance with prior art feed systems, yarn 10 during its descending path of movement is threaded through a first encountered eyelet 44 of guide member 46, partially wrapped about the circumferentially spaced pins 48 of wheel 24, and then threaded through an exit eyelet 50 on its way to the previously noted knitting station 18.

Since, as described, yarn 10 occupies an interposed position, as illustrated in dash lines in FIG. 2, between the master tape 32 and the wheel 24 at the partial wrap therebetween, yarn 10 is fed as a result of this positive contact from its source 12 to the station 18 and the feed movement thereof is at a speed corresponding to the longitudinal feed movement 40 of the tape 32.

The advantages of the prior art feed system just described are well understood. However, as already noted, the contact of yarn 10 with the master feed tape 32 has certain adverse consequences. Among the more significant is the fact that yarn 10 on occasion contains spinning oil, which oil chemically attacks the material of construction of the belt 32 and ultimately results in its rupture. Additionally, it is not uncommon in knitting operations to use diffenent colors of yarn. Thus, it often happens in the prior art set ups of FIGS. 1, 2 that the lint in one color is carried by the movement of the master tape 32 from one knitting station to another and, as a result, said lint attached itself to yarn of a different color. This, in turn, often produces a defect in the manufactured product.

Figure 3:
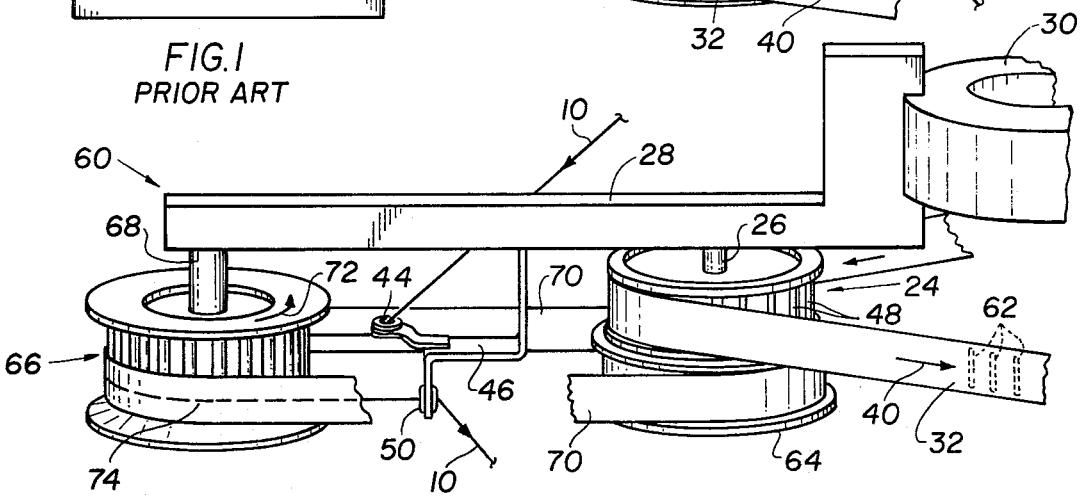
FIG. 3 is a perspective view illustrating the improved feed system hereof.

As an effective solution to the foregoing and other shortcomings of the prior art, use is recommended of the improved feed system illustrated in FIG. 3 to which reference is now made. The structural features similar to those already described will be designated by the same reference numerals and other numbers used for the structural differences so as to highlight said structural differences. Referring to FIG. 3, the improved feed system 60 similarly includes a support bracket 28 appropriately affixed to the machine mounting ring or support structure 30. Also, as already described, mounted in depending relation about rotation axis 26 is the previously noted feed wheel 24. Wheel 24 is one of several arranged in circumferential relation about the knitting machine 20 and, as already described, support a closed loop of master tape 32. In this embodiment of the tape 32, however, there is advantageously provided on the inside surface lateral projections 62 which function like sprocket teeth by projecting themselves in the spacings between the pins 48 and, in this manner, obviating any slippage between the tape 32 and the wheel 24. Unlike the prior art feed system, however, yarn 10 is not fed in interposed relation between the tape 32 and wheel 24, as will now be explained.

Affixed in depending relation from the wheel 24 so as to rotate simultaneously therewith is a first auxiliary feed wheel 64. Cooperating with wheel 64 is a second auxiliary feed wheel 66, said wheel 66 being appropriately journalled for rotation, as at 68, at the end of the bracket 28. Entrained about a cooperating set of wheels 64 and 66 is a comparatively small closed loop of feed tape 70. As clearly shown in FIG. 3, in the space between the feed wheels 64 and 66 and within the closed loop of tape 70 there is advantageously located the guide 46 which includes the previously noted eyelets 44 and 50. Yarn 10 is threaded through eyelet 44, partially wrapped in an interposed position between feed wheel 66 and tape 70, then threaded through the exit eyelet 50 on its way to the knitting station 18.

Thus, the yarn 10 is in contact with the smaller closed loop of tape 70 and cannot therefore adversely affect the material of construction of the larger master tape 32. Yet, longitudinal movement 40 of the master tape 32 is still effectively utilized to provide positive feed of the yarn 10 at a selected speed which corresponds to the speed movement 40 of tape 32. This, of course, is the result of rotation of wheel 64 simultaneously with wheel 24 which, in turn, urges tape 70 through movement causing corresponding rotation 72 in wheel 64. Said wheel 64 together with the tape 70 contacts, on opposite sides, yarn 10 at the partial wrap therebetween, designated 74 in FIG. 3.

Figure 4:
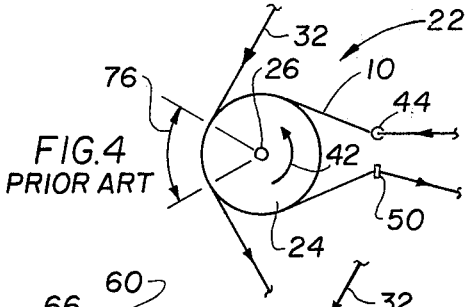
FIG.4 PRIOR ART
FIGS. 4 and 5 are simplified plan views, FIG. 4 being of the prior arts system of FIGS. 1 and 2, and FIG. 5 of the improved system hereof, the comparison therebetween illustrating the improvements provided by the within inventive feed system.
Figure 5:
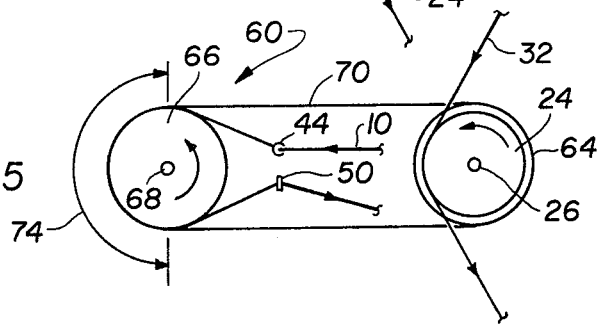

By a comparison of FIGS. 4 and 5, to which reference is now made, it can also be readily noted that the partial wrap 76 of the prior art feed system (FIG. 4) is significantly less than partial wrap 74 (FIG. 5) of the improved feed system 60 hereof. Also, as illustrated in FIG. 5, the two tapes 32 and 70, are initially supported relative to the rotation axis 26 on what can be termed or characterized as a step pulley comprised of the previously noted feed wheel 24 and depending feed wheel 64; thus, the nomenclature used herein is not intended as a limitation on the scope of the invention.

In other respects as well, a latitude of modification change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. In a knittng machine of the type having a control tape for causing yarn feed movement from elevated supply stations to knitting stations located beneath and in vertically aligned relation to said supply stations, the improvement thereto comprising an arrangement of rotatable tape-supporting wheels operatively arranged to support a closed loop of said control tape in surrounding relation about said vertically aligned supply and knitting stations and thereby to be powered in rotation in response to longitudinal movement of said control tape in a looped path, a first auxiliary wheel connected in depending relation to each of a cooperating one of said tape-supporting wheels so as to rotate in unison therewith, a second auxiliary wheel rotatably mounted in an operative clearance position from each said first auxiliary wheel and in a radial orientation to said vertically aligned supply and knitting stations, a radially oriented second closed loop of tape entrained about each cooperating pair of said first and second auxiliary wheels so as to be urged by said rotation of said first auxiliary wheel through feed movement including a partial wrap about said second auxiliary wheel, and a single yarn fed in an interposed position between said second tape loop and said second auxiliary wheel at said partial wrap therebetween so as to be urged by said second tape loop through feed movement at a speed corresponding to the movement speed of said control tape but without actual contact therewith.

* * * * *